US011790830B2

(12) United States Patent
Xu et al.

(10) Patent No.: US 11,790,830 B2
(45) Date of Patent: Oct. 17, 2023

(54) DISPLAY PANEL AND DISPLAY DEVICE

(71) Applicant: Xiamen Tianma Display Technology Co., Ltd., Xiamen (CN)

(72) Inventors: Yuping Xu, Xiamen (CN); Jieliang Li, Xiamen (CN)

(73) Assignee: XIAMEN TIANMA DISPLAY TECHNOLOGY CO., LTD., Xiamen (CN)

( * ) Notice: Subject to any disclaimer, the term of this patent is extended or adjusted under 35 U.S.C. 154(b) by 38 days.

(21) Appl. No.: 17/456,774

(22) Filed: Nov. 29, 2021

(65) Prior Publication Data

US 2023/0076760 A1 Mar. 9, 2023

(30) Foreign Application Priority Data

Sep. 7, 2021 (CN) ..... 202111045950.2

(51) Int. Cl.
*G09G 3/30* (2006.01)

(52) U.S. Cl.
CPC ..... *G09G 3/30* (2013.01); *G09G 2320/0233* (2013.01); *G09G 2320/0626* (2013.01)

(58) Field of Classification Search
CPC ..... G09G 3/30
USPC ..... 345/690
See application file for complete search history.

(56) References Cited

U.S. PATENT DOCUMENTS

| | | | | |
|---|---|---|---|---|
| 2022/0044636 | A1* | 2/2022 | Mou | G09G 3/3233 |
| 2022/0069027 | A1* | 3/2022 | Wang | H10K 59/121 |
| 2022/0157233 | A1* | 5/2022 | Zheng | G09G 3/3208 |
| 2022/0206622 | A1* | 6/2022 | Yamanaka | G06F 3/0412 |
| 2022/0293057 | A1* | 9/2022 | Shang | H10K 59/131 |

* cited by examiner

*Primary Examiner* — Prabodh M Dharia
(74) *Attorney, Agent, or Firm* — ANOVA LAW GROUP PLLC

(57) ABSTRACT

A display panel and a display device are provided. The display panel includes a pixel circuit, a light-emitting element, and a signal line group. The pixel circuit includes a driving transistor, a data writing transistor, and a first transistor. The first electrode of the first transistor in a first metal layer is connected to a gate of the driving transistor. A side of the first electrode of the first transistor facing the first electrode of the data writing transistor is a first edge and a side of a first electrode of the data writing transistor facing the first electrode of the first transistor is a second edge. Orthographically projected on a plane parallel to the display panel, at least a partial region of at least one signal line is located between the first edge and the second edge, and is arranged in a layer different from the first metal layer.

20 Claims, 13 Drawing Sheets

DISPLAY PANEL AND DISPLAY DEVICE

CROSS-REFERENCE TO RELATED APPLICATION

This application claims the priority of Chinese Patent Application No. 202111045950.2, filed on Sep. 7, 2021, the content of which is incorporated herein by reference in its entirety.

TECHNICAL FIELD

The present disclosure generally relates to the field of display technologies and, more particularly, relates to a display panel and a display device.

BACKGROUND

In a display panel, a pixel circuit provides driving current required for display to light-emitting elements of the display panel, and controls whether the light-emitting elements enter a light-emitting stage. Correspondingly, the pixel circuit becomes an indispensable element in most self-luminous display panels.

However, in the pixel circuit, a parasitic capacitance is often formed between a wiring connected to a gate of a driving transistor and other wirings on a same layer, and the existence of the parasitic capacitance will cause the current flowing through the light-emitting elements to change, resulting differences between actual display brightness and ideal brightness. Display effect of the display panel is affected.

SUMMARY

One aspect of the present disclosure provides a display panel. The display panel includes a pixel circuit, a light-emitting element, and a signal line group including at least one signal line for providing control signals or input signals for transistors in the pixel circuit. The pixel circuit includes transistors including a driving transistor for providing a driving current to the light-emitting element, a data writing transistor for providing a data signal to the driving transistor, and a first transistor. The data writing transistor is connected between a first electrode of the driving transistor and a data signal line. A first electrode of the first transistor is connected to a gate of the driving transistor. The first electrode of the first transistor and a first electrode of the data writing transistor are located in a first metal layer. A side of the first electrode of the first transistor facing the first electrode of the data writing transistor is a first edge and a side of the first electrode of the data writing transistor facing the first electrode of the first transistor is a second edge. When being orthographically projected on a plane parallel to a surface of the display panel, at least part of at least one signal line in the signal line group is located between the first edge and the second edge, and the at least a partial region of the at least one signal line and the first metal layer are arranged in different layers.

Another aspect of the present disclosure provides a display device. The display device includes a display panel. a pixel circuit, a light-emitting element, and a signal line group including at least one signal line for providing control signals or input signals for transistors in the pixel circuit. The pixel circuit includes transistors including a driving transistor for providing a driving current to the light-emitting element, a data writing transistor for providing a data signal to the driving transistor, and a first transistor. The data writing transistor is connected between a first electrode of the driving transistor and a data signal line. A first electrode of the first transistor is connected to a gate of the driving transistor. The first electrode of the first transistor and a first electrode of the data writing transistor are located in a first metal layer. A side of the first electrode of the first transistor facing the first electrode of the data writing transistor is a first edge and a side of the first electrode of the data writing transistor facing the first electrode of the first transistor is a second edge. When being orthographically projected on a plane parallel to a surface of the display panel, at least a partial region of at least one signal line in the signal line group is located between the first edge and the second edge, and the at least part of the at least one signal line and the first metal layer are arranged in different layers.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
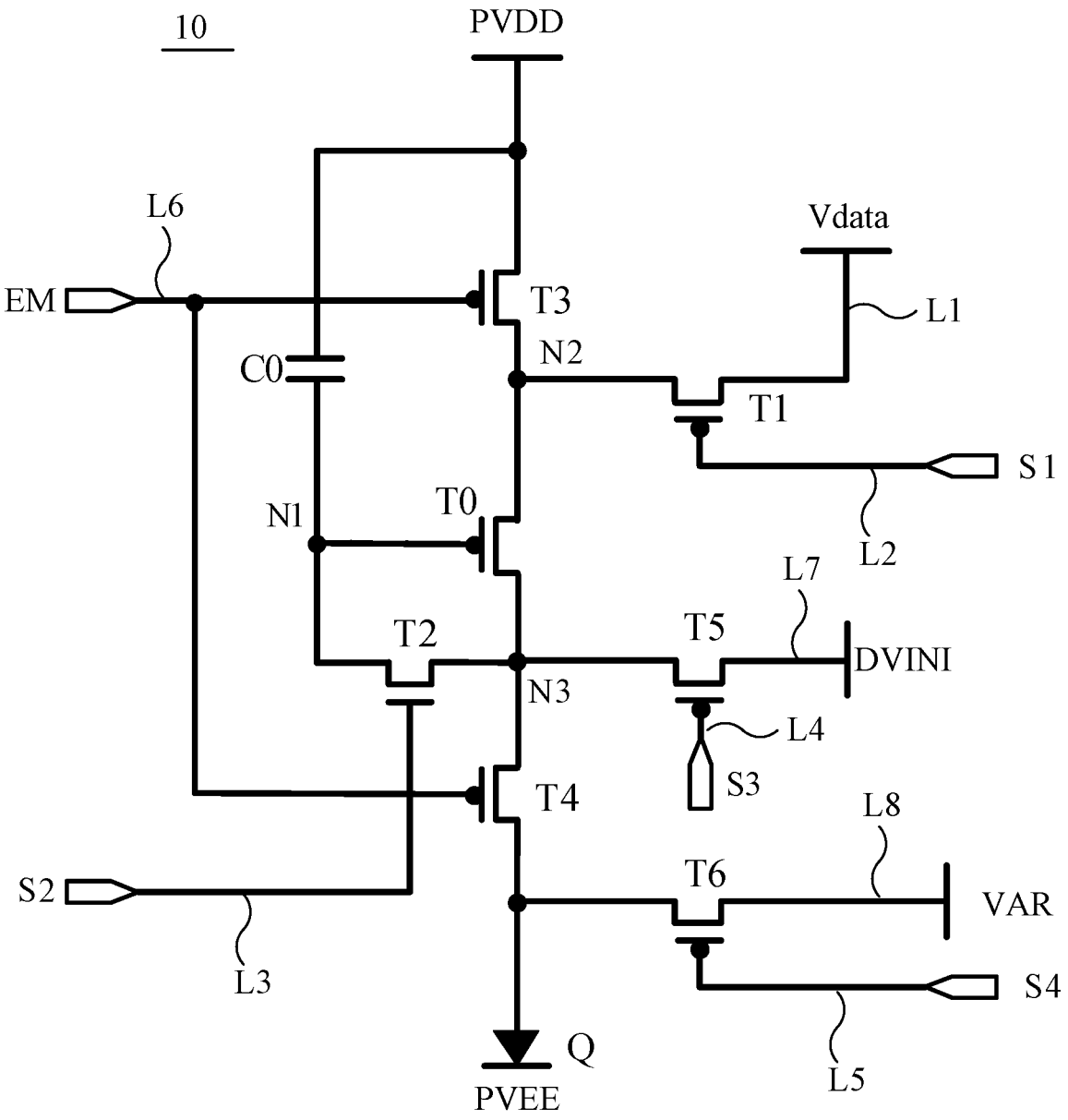
FIG. 1 illustrates a circuit structure of a pixel circuit in an exemplary display panel consistent with various disclosed embodiments in the present disclosure.

Reference will now be made in detail to exemplary embodiments of the disclosure, which are illustrated in the accompanying drawings. Hereinafter, embodiments consistent with the disclosure will be described with reference to drawings. In the drawings, the shape and size may be exaggerated, distorted, or simplified for clarity. Wherever possible, the same reference numbers will be used throughout the drawings to refer to the same or like parts, and a detailed description thereof may be omitted.

Further, in the present disclosure, the disclosed embodiments and the features of the disclosed embodiments may be combined under conditions without conflicts. It is apparent that the described embodiments are some but not all of the embodiments of the present disclosure. Based on the disclosed embodiments, persons of ordinary skill in the art may derive other embodiments consistent with the present disclosure, all of which are within the scope of the present disclosure.

Moreover, the present disclosure is described with reference to schematic diagrams. For the convenience of descriptions of the embodiments, the cross-sectional views illustrating the device structures may not follow the common proportion and may be partially exaggerated. Besides, those schematic diagrams are merely examples, and not intended to limit the scope of the disclosure. Furthermore, a three-dimensional (3D) size including length, width, and depth should be considered during practical fabrication.

The present disclosure provides a display panel. The display panel may include a pixel circuit. FIG. 1 shows a circuit structure of an exemplary pixel circuit in the display panel provided by one embodiment of the present disclosure. The display panel may include a pixel circuit 10 and a light-emitting element Q. The pixel circuit 10 may include a driving transistor T0, a data writing transistor T1, and a first transistor T2. The driving transistor T0 may be used to provide driving current to the light-emitting element Q, and the data writing transistor T1 may be used to provide a data signal Vdata to the driving transistor T0.

The data writing transistor T1 may be connected between a first electrode of the driving transistor T0 and a data signal line L1, and a first electrode of the first transistor T2 may be connected to a gate of the driving transistor T0 to form a first node N1.

As shown in FIG. 1, a first electrode of the data writing transistor T1 may be used to receive the data signal Vdata, and a second electrode of the data writing transistor T1 may be connected to the first electrode of the driving transistor T0 to form a second node N2. A gate of the data writing transistor T1 may be used to receive a control signal S1. In some embodiments, the first electrode of the data writing transistor T1 may be connected to the first electrode of the driving transistor T0 to form the second node N2, and the second electrode of the data writing transistor T1 may be used to receive the data signal Vdata. The control signal S1 received by the data writing transistor T1 may be a pulse signal, and an effective pulse of the control signal S1 may control the data writing transistor T1 to be in an on state to provide the data signal Vdata to the driving transistor T0, and an invalid pulse of the control signal S1 may control the data writing transistor T1 to be in an off state. Therefore, under the control of the control signal S1, the data writing transistor T1 may selectively provide the data signal Vdata to the driving transistor T0.

As shown in FIG. 1, a second electrode of the driving transistor T0 may be coupled and connected to the light-emitting element Q, to provide the driving current to the light-emitting element Q after the driving transistor T0 and light-emitting control transistors T3 and T4 are in the on state.

As shown in FIG. 1, in one embodiment, the first transistor T2 may be a compensation transistor to compensate a threshold voltage of the driving transistor T0. A first electrode of the first transistor T2 may be connected to the gate of the driving transistor T0, and a second electrode of the first transistor T2 may be connected to the second electrode of the driving transistor T0 to form a third node N3. A gate of the first transistor T2 may be used to receive a control signal S2. The control signal S2 received by the first transistor T2 may be a pulse signal, and an effective pulse of the control signal S2 may control the first transistor T2 to be in an on state to compensate the threshold voltage of the driving transistor T0, and an invalid pulse of the control signal S2 may control the first transistor T2 to be in an off state. Therefore, under the control of the control signal S2, the first transistor T2 may selectively compensate the threshold voltage of the driving transistor T0.

Optionally, in one embodiment, as shown in FIG. 1, the pixel circuit 10 may further include a second transistor T3 and a third transistor T4. The second transistor T3 may be connected between a first power signal terminal PVDD and the first electrode of the driving transistor T0, and the third transistor T4 may be connected between the second electrode of the driving transistor T0 and the light-emitting element Q, to control the pixel circuit 10 to be in a light-emitting stage or a non-light-emitting stage.

A gate of the second transistor T3 and a gate of the third transistor T4 may receive a control signal EM simultaneously. Under the control of the control signal EM, the third transistor T4 may be in the on state or the off state. The control signal EM received by the third transistor T4 may be a pulse signal. In the light-emitting state, the control signal EM may output an effective pulse to control the third transistor T4 to be in the on state, such that the driving current provided by the driving transistor T0 may enter the light-emitting element Q to make the light-emitting element Q emit light. In the non-light-emitting state, the control signal EM may output an invalid pulse to control the third transistor T4 to be in the off state, such that the light-emitting element Q does not emit light.

Optionally, as shown in FIG. 1, the pixel circuit 10 may further include a fourth transistor T5. A first electrode of the fourth transistor T5 may receive a reset signal DVINI, and a second electrode of the fourth transistor T5 may be connected to the second electrode of the driving transistor T0. A gate of the fourth transistor T5 may receive a control signal S3. The control signal S3 received by the fourth transistor T5 may be a pulse signal, and the effective pulse of the control signal S3 may control the fourth transistor T5 to be in an on state to reset the gate of the driving transistor T0 and the invalid pulse of the control signal S3 may control the fourth transistor T5 to be in the off state. In the reset phase of the pixel circuit 10, the first transistor T2 may be in the on state under the control of the control signal S2, and the fourth transistor T5 may be in the on state under the control of the control signal S3. Correspondingly, the reset signal DVINI may pass the fourth transistor T5 and the first transistor T2 to be written into the gate of the driving transistor T0, for resetting the gate of the driving transistor T0.

Optionally, as shown in FIG. 1, the pixel circuit 10 may further include a fifth transistor T6. A first electrode of the fifth transistor T6 may receive an initialization signal VAR, and a second electrode of the fifth transistor T6 may be connected to the anode of the light-emitting element Q. A gate of the fifth transistor T6 may receive a control signal S4. The control signal S4 received by the fifth transistor T6 may be a pulse signal. The effective pulse of the control signal S4 may control the fifth transistor T6 to be in the on state such that the initialization signal VAR is written into the anode of the light-emitting element Q through the fifth transistor T6 to initialize the light-emitting element Q. The invalid pulse of the control signal S4 may control the fifth transistor T6 to be in the off state.

The anode of the light-emitting element Q may be connected to a second power signal terminal PVEE.

Optionally, as shown in FIG. 1, the pixel circuit 10 may further include a storage capacitor C0. A first electrode plate of the storage capacitor C0 may be connected to the first power signal terminal PVDD, and a second electrode plate of the storage capacitor C0 may be connected to the first node N1.

The display panel may further include a signal line group. The signal line group may include at least one signal line that provides a control signal or an input signal to the transistors of the pixel circuit 10. For example, as shown in FIG. 1, the signal line group may include a signal line L1 providing the data signal Vdata, a signal line L2 providing the control signal S1, a signal line L3 providing the control signal S2, a signal line L4 providing the control signal S3, a signal line L5 providing the control signal S4, a signal line L6 providing the control signal EM, a signal line L7 providing the reset signal DVINI, a signal line L8 providing the initialization signal VAR, and so on.

Figure 2:
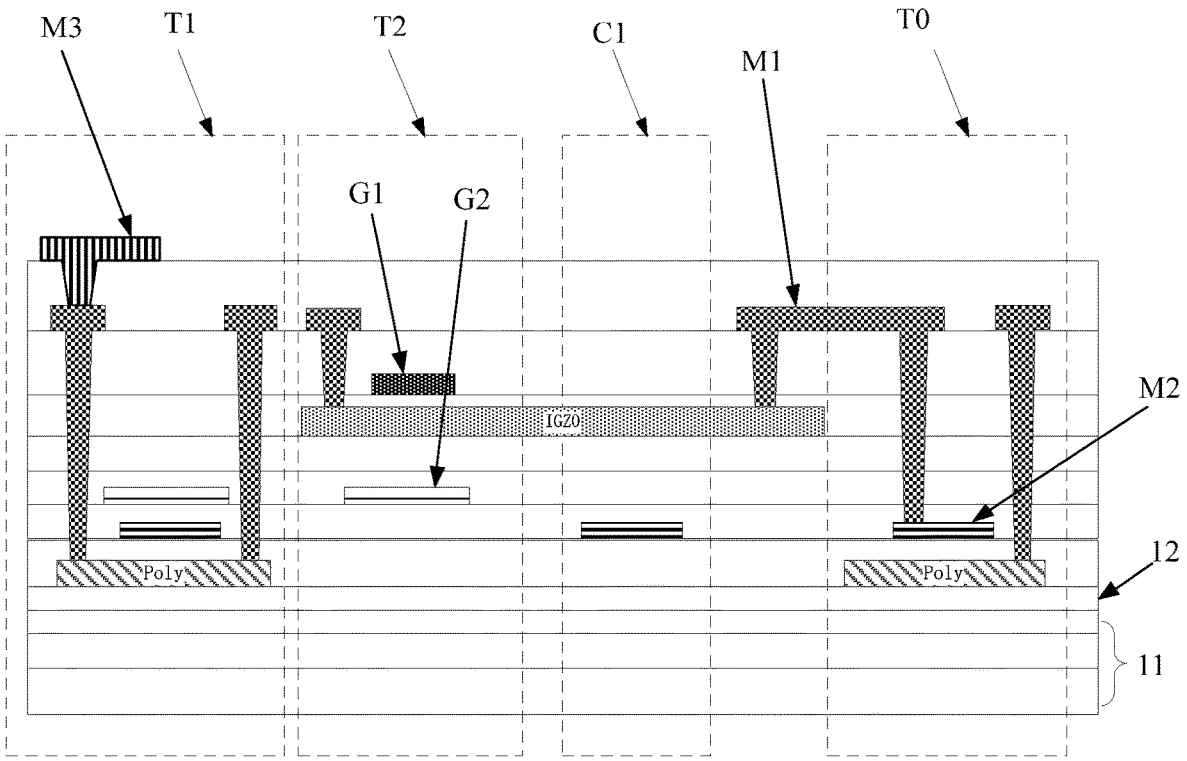
FIG. 2 illustrates a sectional view of an exemplary display panel consistent with various disclosed embodiments in the present disclosure.

FIG. 2 shows a sectional view of the display panel provided by one embodiment of the present disclosure.

As shown in FIG. 2, the first electrode of the first transistor T2 may be located on a first metal layer M1, and the first electrode of the data writing transistor T1 may be located on the first metal layer M1. It can be seen that, based on the current display panel structure, the first electrode of the first transistor T2 and the first electrode of the data writing transistor T1 may be located on a same layer, that is, on the first metal layer M1 at the same time. Then, when the distance between the first electrode of the first transistor T2 and the first electrode of the data writing transistor T1 is small, or there is no other structure between the first electrode of the first transistor T2 and the first electrode of the data writing transistor T1, a lateral electric field and a parasitic capacitance may be generated the first electrode of the first transistor T2 and the first electrode of the data writing transistor T1, therefore affecting the stability of the gate voltage of the driving transistor T0 and ultimately affecting the display performance of the display panel.

Specifically, in the data writing stage, the signal on the data signal line L1 may be written to the gate of the driving transistor T0, and the gate voltage of the driving transistor TO may be an important factor for determining the driving current. Correspondingly, the stability of the gate voltage of the driving transistor T0 may need to be high. Also, the first electrode of the first transistor T2 may be connected to the gate of the driving transistor T0. Therefore, he stability of the voltage of the first electrode of the first transistor T2 may need to be high indirectly.

Correspondingly, when a lateral electric field and then a parasitic capacitance are generated between the first electrode of the first transistor T2 and the first electrode of the data writing transistor T1, the voltage of the first electrode of the first transistor T2 may be susceptible to change, and the gate voltage of the driving transistor T0 then may also change with it. Therefore, the stability of the gate voltage of the driving transistor T0 may be affected and ultimately the display performance of the display panel may be affected.

Figure 3:
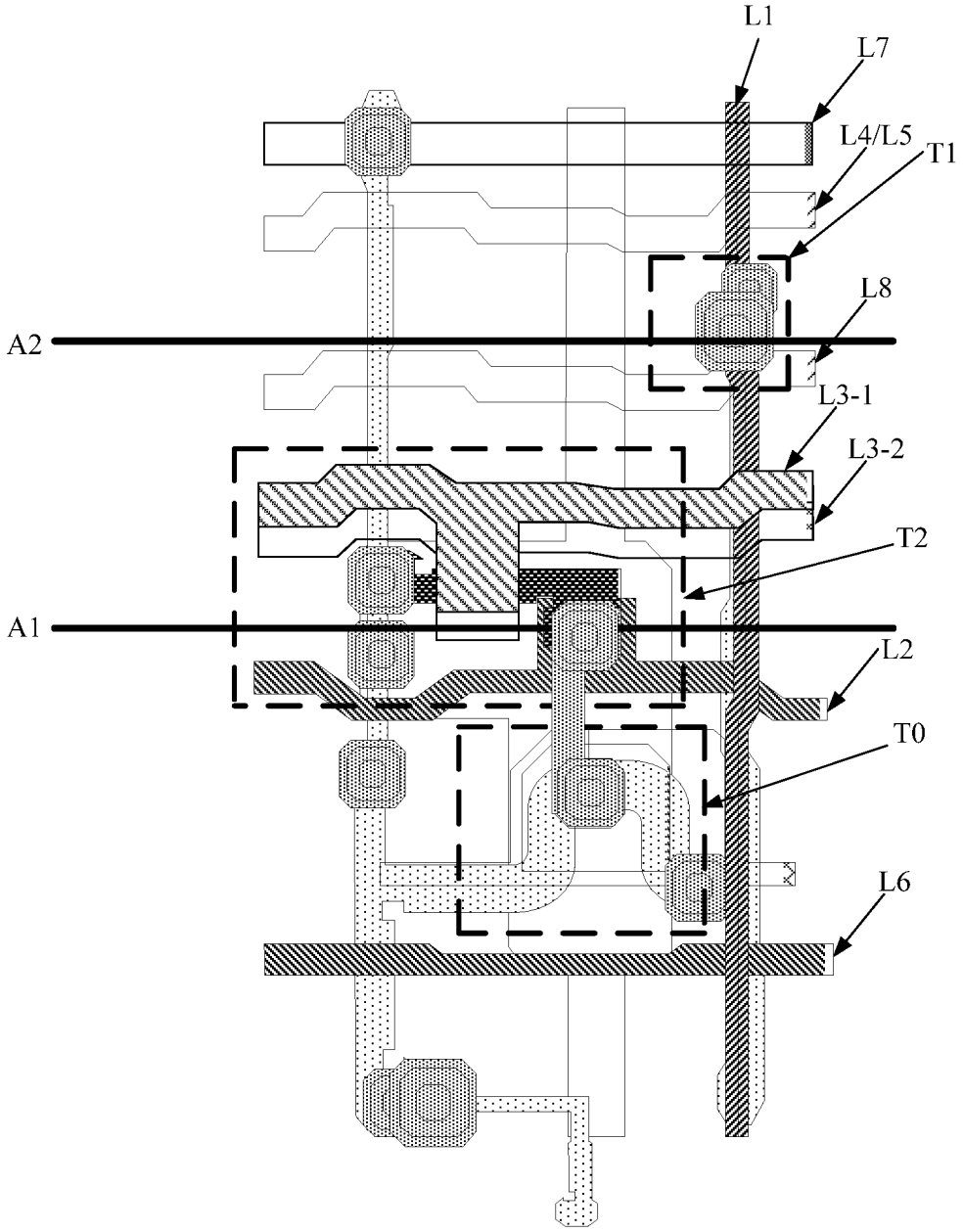
FIG. 3 illustrates a circuit layout of a pixel circuit in an exemplary display panel consistent with various disclosed embodiments in the present disclosure.

FIG. 3 shows a circuit layout of the pixel circuit in the display panel provided by one embodiment of the present disclosure.

As shown in FIG. 3, to improve the stability of the gate voltage of the driving transistor T0, a side of the first electrode of the first transistor T2 facing the first electrode of the data writing transistor T1 is defined as the first edge A1, and a side of the first electrode of the data writing transistor T1 facing the first electrode of the first transistor T2 is defined as the second edge A2.

As shown in FIG. 3, there may be at least a partial area with at least one signal line between the first edge A1 and the second edge A2. That is, when it is orthographically projected to a plane parallel to the surface of the display panel, at least a part of at least one signal line in the signal line group may be located between the first edge A1 and the second edge A2, and the at least part of the at least one signal line may be arranged in a layer different from the first metal layer. Correspondingly, after a lateral electric field is generated between the first electrode of the first transistor T2 and the first electrode of the data writing transistor T1, the at least part of the at least one signal line located between the first edge A1 and the second edge A2 may block electric field lines to weaken the electric field in the local area, thereby reducing the parasitic capacitance. The voltage stability of the first electrode of the first transistor T2 may be improved, thereby enhancing the stability of the gate voltage of the driving transistor T0.

To avoid the formation of a lateral electrical field when the signal line between the first edge A1 and the second edge A2 and the first electrode of the first transistor T2 and/or the first electrode of the data writing transistor T1 are in the same layer, the signal line between the first edge A1 and the second edge A2 and the first metal layer M1 may be arranged in different layers, such that unnecessary interference to the first electrode of the first transistor T2 and/or the first electrode of the data writing first transistor T1 on the same layer may be avoided. The stability of the gate voltage of the driving transistor T0 may be further improved.

It should be noted that in this embodiment, to better illustrate the relationship between the first edge A1, the second edge A2, and the electric field lines between the first edge A1 and the second edge A2, orthographic projection to the panel parallel to the surface of the display panel are used to illustrate the relationship of each structure on the plane. An orthographic projection can also be considered as a vertical projection. That is, each structure that is not originally located on the same film layer is projected vertically onto the same plane, and the relationship between each structure is explained.

Optionally, in one embodiment, the gate of the driving transistor T0 may be located in the second metal layer M1, the first electrode of the first transistor T2 may be located in the first metal layer M2, and the gate of the driving transistor T0 may be connected to the first electrode of the first transistor T2 through a via hole.

The data signal line L1 may be located on the third metal layer M3. Correspondingly, to realize the connection between the data signal line L1 and the data writing transistor T1, if no special design is made, a hole may be required to make the data signal line L1 directly connected to an active layer poly of the data writing transistor T1, that is to say, it may need to be punched from the third metal layer M3 to the active layer of the data writing transistor T1.

If a distance from the position of the active layer of the data writing transistor T1 to the third metal layer M3 is relatively large, for example, as shown in FIG. 2, when the active layer of the data writing transistor T1 is a poly layer, it may be disposed closer to the base substrate. If a hole is punched from the third metal layer M3 to the active layer of the data writing transistor T1, a depth of the hole may be large, which may affect the stability of the connection between the data signal line L1 and the active layer. Therefore, as shown in FIG. 2, in the present disclosure, a hole may be formed from the third metal layer M3 to the first metal layer M2 by punching, and then a hole may be formed from the first metal to the active layer of the data writing transistor T1 by punching. That is, the first electrode of the data writing transistor T1 may be located in the first metal layer M1, and the data signal line L1 may be connected to the first electrode of the data writing transistor T1 through the via hole between the third metal layer M3 and the first metal layer M1. It can be seen that, based on the current display panel structure, the first electrode of the first transistor T2 and the first electrode of the data writing transistor T1 may be located on the same layer, that is, on the first metal layer M1 at the same time.

Optionally, in another embodiment of the present invention, the pixel circuit 10 may include silicon transistors and oxide semiconductor transistors. An active layer of a silicon transistor may include silicon, and an active layer of an oxide semiconductor transistor may include oxide semiconductor. In a direction perpendicular to the surface of the display panel, an oxide semiconductor transistor may include a top gate and a bottom gate located on both sides of the active layer. The top gate may be located on the side of the bottom gate facing the first metal layer M1. The first transistor T2 may be one of the oxide semiconductor transistors.

Optionally, in one embodiment, the data writing transistor T2 may be one of the aforementioned silicon transistors. The gate of the data writing transistor may be located in the second metal layer M2, and the active layer may include low temperature polysilicon.

As shown in FIG. 2, the first transistor T2 may include a top gate G1 and a bottom gate G2 located on two sides of the active layer IGZO, between the second metal layer M2 and the first metal layer M1. That is, as shown in FIG. 2, the second metal layer M2 may be located on the side of the bottom gate G2 facing the base substrate 11. In addition, the display panel may further include a multi-layer dielectric layer other than the base substrate 11 and the buffer layer 12 to achieve isolation and insulation between layers.

In this embodiment, the base substrate 11 may have a multi-layer structure, and may be a flexible insulating material base substrate. The base substrate 11 may have characteristics of stretchable, bendable, or bendable. The material may include but is not limited to polyimide amine material (PI), polycarbonate material (PC), or polyethylene terephthalate material (PET), etc.

Optionally, the buffer layer 12 may include but is not limited to an inorganic material layer or an organic material layer. The material of the inorganic material layer may include but is not limited to silicon oxide, silicon nitride, silicon oxynitride, aluminum oxide, aluminum nitride, etc. The material of the organic material layer may include but is not limited to acrylic or PI.

In one embodiment, the first transistor T2 may be an oxide semiconductor transistor. Since the first electrode of the first transistor T2 is connected to the gate of the driving transistor T0 and the gate voltage of the driving transistor T0 has an important influence on the driving current, in the light-emitting phase, the stability of the gate voltage of the driving transistor T0 may need to be very high. This may requires that when the first transistor T2 is in the off state, its leakage current may be sufficiently small. The oxide semiconductor transistor has a small leakage current. Therefore, setting the first transistor T2 as an oxide semiconductor transistor may be beneficial to stabilizing the gate voltage of the driving transistor T0.

Further, it should be noted that in this embodiment, the driving transistor may be an oxide semiconductor transistor or a silicon transistor, that is, the active layer may be the silicon-based active layer poly shown in FIG. 2, or an oxide semiconductor active layer IGZO such as the first transistor T2.

In addition, it should be noted that the pixel circuit shown in FIG. 1 is only a case of the pixel circuit included in the embodiments of the present disclosure, and any pixel circuit layout structure that meets the characteristics defined in the present disclosure belongs to the protection scope of the present disclosure. In the present disclosure, the first transistor T2 may be the compensation transistor shown in FIG. 1. In other embodiments of the present disclosure, the pixel circuit may further include a reset transistor connected to the gate of the driving transistor and the reset signal terminal. The reset transistor may be used to provide a reset signal to the gate of the driving transistor, and the first transistor T2 may be a reset transistor.

Figure 4:
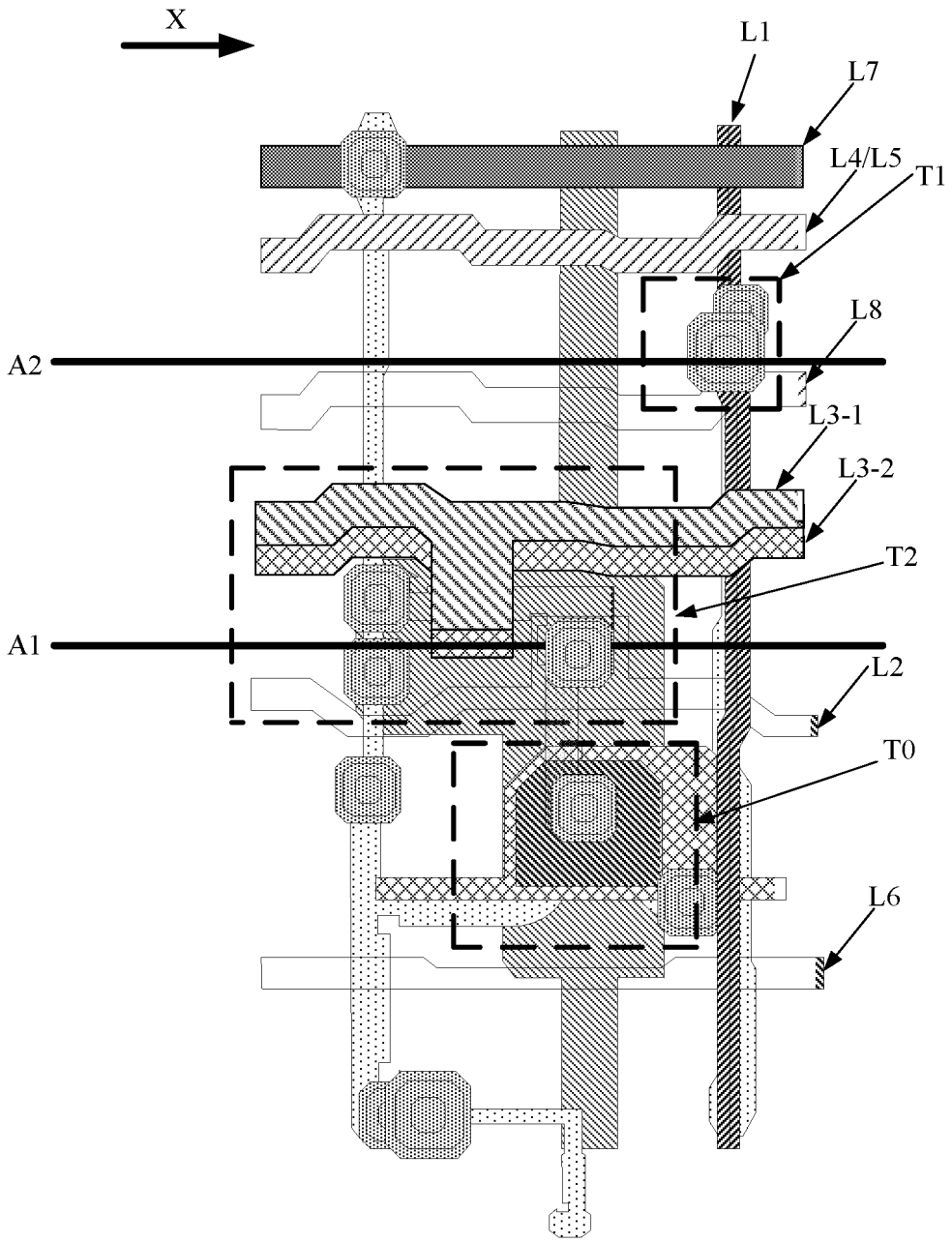
FIG. 4 illustrates another circuit layout of a pixel circuit in an exemplary display panel consistent with various disclosed embodiments in the present disclosure.

FIG. 4 illustrates another circuit layout of a pixel circuit in an display panel provided by another embodiment of the present disclosure. When being orthographically projected to the plane parallel to the surface of the display panel, at least part of the area of the first signal line L3-1 in the signal line group may be located between the first edge A1 and the second edge A2, and at least part of the area of the second signal line L3-2 in the signal line group may be also located between the first edge A1 and the second edge A2. The first signal line L3-1 may be connected to the top gate G1 of the first transistor T2, to provide the control signal to the top gate G1 of the first transistor T2. The second signal line L3-2 may be connected to the bottom gate G2 of the first transistor T2 to provide the control signal to the bottom gate G2 of the first transistor T2. The first signal line L3-1 and the second signal line L3-2 may extend in a first direction X.

That is, in conjunction with FIG. 2, based on the structure that the first transistor T2 is an oxide semiconductor transistor, the first transistor T2 may have the top gate G1 and the bottom gate G2 located in different layers. Correspondingly, the first signal line L3-1 that provides the control signal for the top gate G1 of the first transistor T2 and the second signal line L3-2 that provides the control signal for the bottom gate G2 of the first transistor T2 may also located in different layers. Since the top gate G1 and the bottom gate G2 may be located in layers different from the first metal layer M1, the first signal line L3-1 may be generally set to be located on the same layer as the top gate G1, and the second signal line L3-2 may be generally set to be located on the same layer as the bottom gate G2, the first signal line L3-1 and the second signal line L3-2 may be located in layers different from the first metal layer M1. That is, the first signal line L3-1, the second signal line L3-2 and the first metal layer M1 may be disposed in different layers.

First, the first signal line L3-1 and the second signal line L3-2 in different layers may be located between the first edge A1 and the second edge A2. Based on the characteristics of the different layers, when adjusting the distance between adjacent signal lines and the width of the signal line itself, the limitation of adjustment may be small when the layout size is limited.

Secondly, the first transistor T2 may have the top gate G1 and the bottom gate G2, and the first signal line L3-1 and the second signal line L3-2 in different layers are naturally generated correspondingly. In this embodiment, the first signal The line L3-1 and the second signal line L3-2 may be located between the first edge A1 and the second edge A2, such that two signal lines at different layers may be located between the first edge A1 and the second edge A2 at the same time. From the perspective of blocking electric field lines, two signal lines in different layers can block more electric field lines, thereby better weakening the electric field between the first edge A1 and the second edge A2. The parasitic capacitance may be reduced and the stability of the gate voltage of the driving transistor T0 may be improved.

Optionally, in another embodiment of the present disclosure, as shown in FIG. 4, when being orthographically projected to the plane parallel to the surface of the display panel, the first edge A1 and the second edge A2 may be located at two sides of the first signal line L3-1 formed after extending along the first direction X, and the first edge A1 and the second edge A2 may be also located at two sides of the second signal line L3-2 formed after extending along the first direction X.

In other words, the first signal line L3-1 and the second signal line L3-2 themselves may be directly located between the first edge A1 and the second edge A2, to directly block the electric field line between the first edge A1 and the second edge A2.

Figure 5:
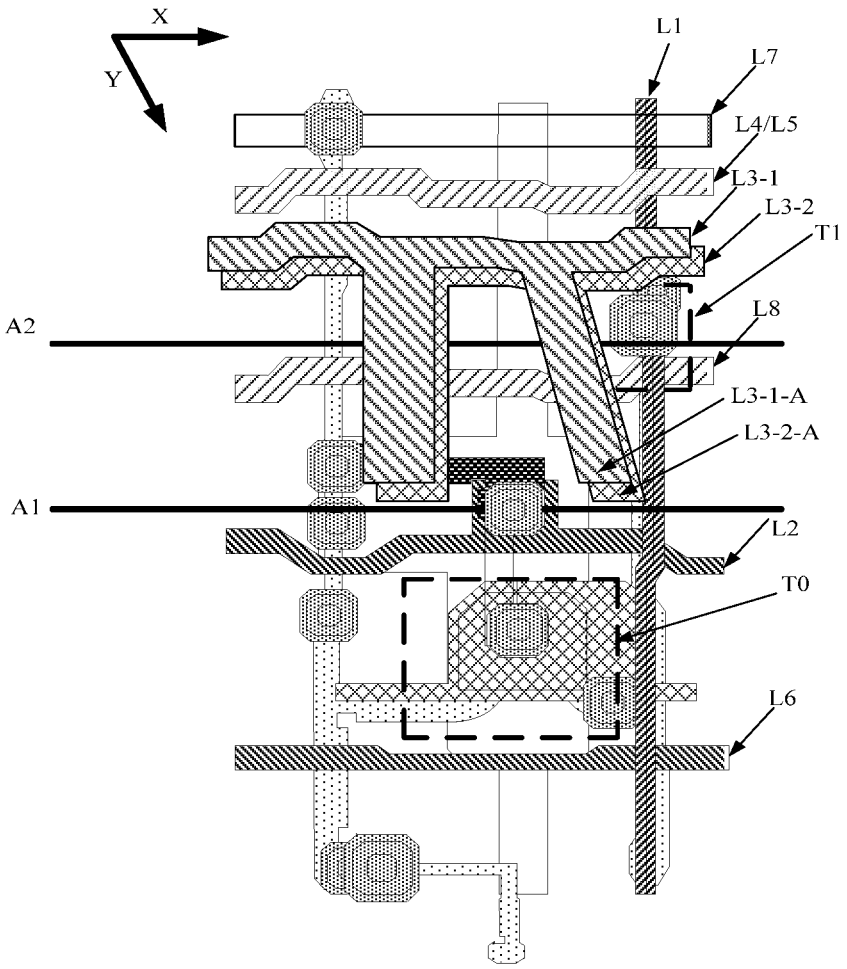
FIG. 5 illustrates another circuit layout of a pixel circuit in an exemplary display panel consistent with various disclosed embodiments in the present disclosure.

FIG. 5 illustrates another circuit layout of a pixel circuit in an display panel provided by another embodiment of the present disclosure.

As shown in FIG. 5, the first signal line L3-1 may include a first protrusion L3-1-A extending in the second direction Y, and the second signal line L3-2 may include a second protrusion L3-2-A extending in a second direction Y. The first direction X and the second direction Y may intersect. Particularly, in one embodiment, the first direction X may be perpendicular to the second direction Y.

The first edge A1 and the second edge A2 may be located at two sides formed by the first protrusion L3-1-A after extending along the second direction Y, and the first edge A1 and the second edge A2 may also located at two sides formed by the second protrusion L3-2-A after extending along the second direction Y. In some other embodiments, the first protrusion L3-1-A may also be a fold line or a curve, which may first extend along the second direction Y and then be folded to extend in the first direction X, as long as the first edge A1 and the second edge A2 are located at the two sides formed after the extension of the first protrusion L3-1-A. Similarly, the second protrusion L3-2-A may also be a fold line or a curve, which may first extend along the second direction Y and then be folded to extend in the first direction X, as long as the first edge A1 and the second edge A2 are located at the two sides formed by the extension of the second protrusion L3-2-A.

That is, in the case where the first signal line L3-1 and the second signal line L3-2 are not located between the first edge A1 and the second edge A2 and it is impossible to block the electric filed lines between the first edge A1 and the second edge A2, the wiring form of the first signal line L3-1 and the second signal line L3-2 can be improved, such that the first signal line L3-1 may include the first protrusion L3-1-A extending in the second direction Y and the second signal line L3-2 may include the second protrusion L3-2-A extending in the second direction Y. Correspondingly, the first edge A1 and the second edge A2 may be located at two sides of the first protrusion L3-1-A after extending in the second direction Y, and the first edge A1 and the second edge A2 may also located at two sides of the second convex portion L3-2-A after extending in the second direction Y.

The first signal line L3-1 and the second signal line L3-2 may be arranged in different layers, and also arranged in different layers from the first metal layer M1, that is, the first signal line L3-1, the second signal line L3-2, and the first metal layer M1 are arranged in different layers. Correspondingly, the first protrusion L3-1-A and the second protrusion L3-2-A may be also located in different layers, and at the same time, they may be located in layers different from the first metal layer M1.

In the case where the first protrusion L3-1-A and the second protrusion L3-2-A are located between the first edge A1 and the second edge A2, it may be also possible to block the electric filed lines between the first edge A1 and the second edge A2. The electric field in the local area may be weakened, thereby reducing the parasitic capacitance and enhancing the stability of the gate voltage of the driving transistor T0.

Figure 6:
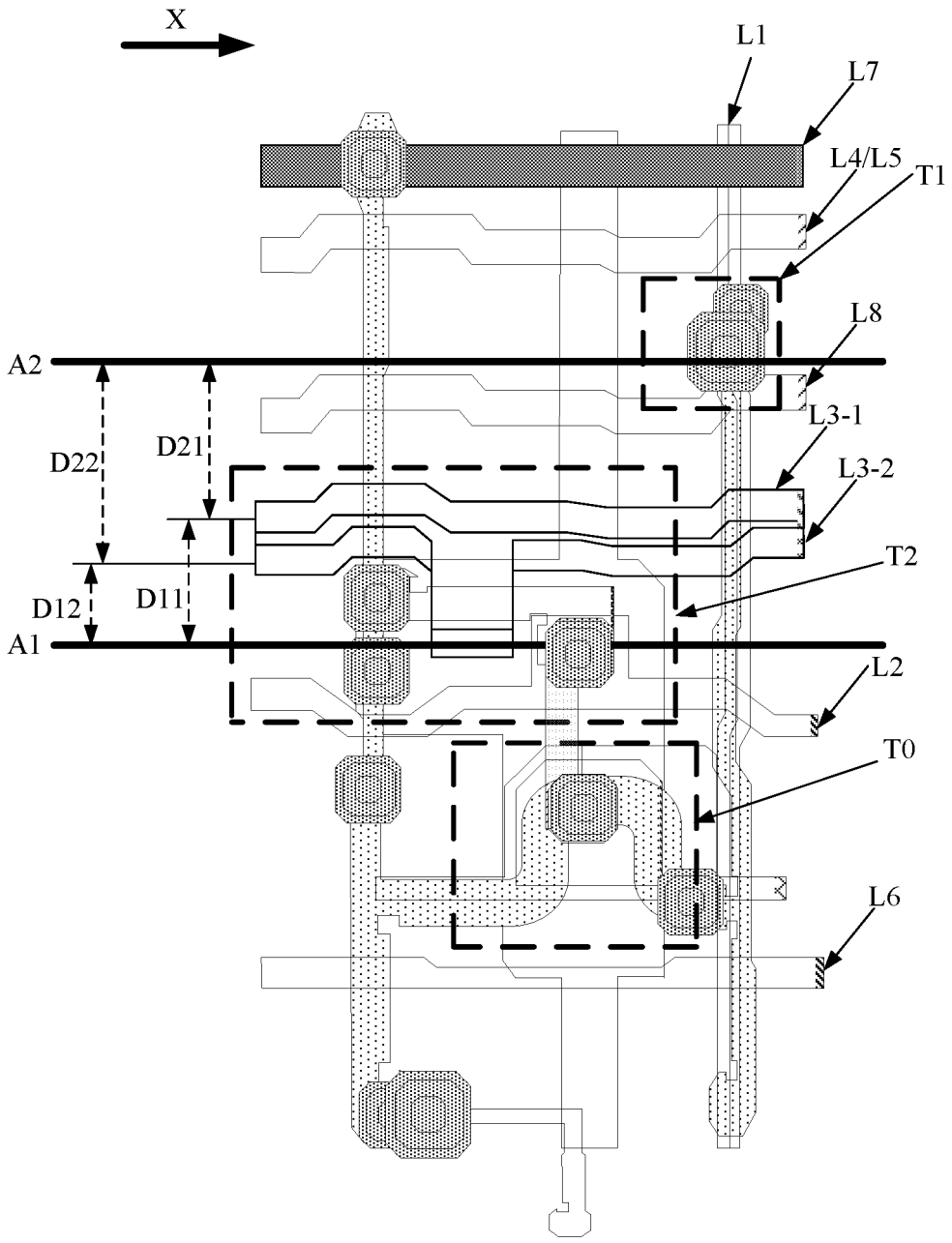
FIG. 6 illustrates another circuit layout of a pixel circuit in an exemplary display panel consistent with various disclosed embodiments in the present disclosure.

FIG. 6 illustrates another circuit layout of a pixel circuit in an display panel provided by another embodiment of the present disclosure.

As shown in FIG. 6, when being orthographically projected onto the plane parallel to the surface of the display panel, a distance from the portion of the first signal line L3-1 located between the first edge A1 and the second edge A2 to the first edge A1 may be D11, and a distance from the portion of the signal line L3-2 located between the first edge A1 and the second edge A2 to the first edge A1 may be D12.

A distance from the portion of the first signal line L3-1 located between the first edge A1 and the second edge A2 to the second edge A2 may be D21, and a distance from the portion of the signal line L3-2 located between the first edge A1 and the second edge A2 to the second edge A2 may be D22.

D11>D21, and/or, D12>D22.

That is to say, the first signal line L3-1 and the second signal line L3-2 can be further optimized to improve block of the electric field lines, on the premise that the electric field lines between the first edge A1 and the second edge A2 can be blocked.

Since the first edge A1 may be one side of the first electrode of the first transistor T2 facing the first electrode of the data writing transistor T1, and the first electrode of the first transistor T2 may be connected to the gate of the driving transistor T0, it can be understood that the first edge A1 may be connected to the gate of the driving transistor T0.

If the first signal line L3-1 and/or the second signal line L3-2 are closer to the first edge A1, the first signal line L3-1 and/or the second signal line L3-2 may also interfere with the first edge A1, which in turn may affect the stability of the gate voltage of the driving transistor T0.

To reduce the interference of the first edge A1 and fully ensure the stability of the gate voltage of the driving transistor T0, the distance from the first signal line L3-1 and/or the second signal line L3-2 to the first edge A1 may be set to be large enough, that is, D11>D21, and/or, D12>D22.

It should be noted that under the conditions of D11>D21 and D12>D22, theoretically the interference of the first edge A1 may be smallest. In this state, the stability of the gate voltage of the driving transistor T0 may be the best.

It should be noted that the length of the two-way arrows of the distance between the first signal line L3-1, the second signal line L3-2, the first edge A1 and the second edge A2 in FIG. 6 do not indicate the numerical value of the distance. The specific relationship between the size of each spacing is subject to the text in the specification.

Figure 7:
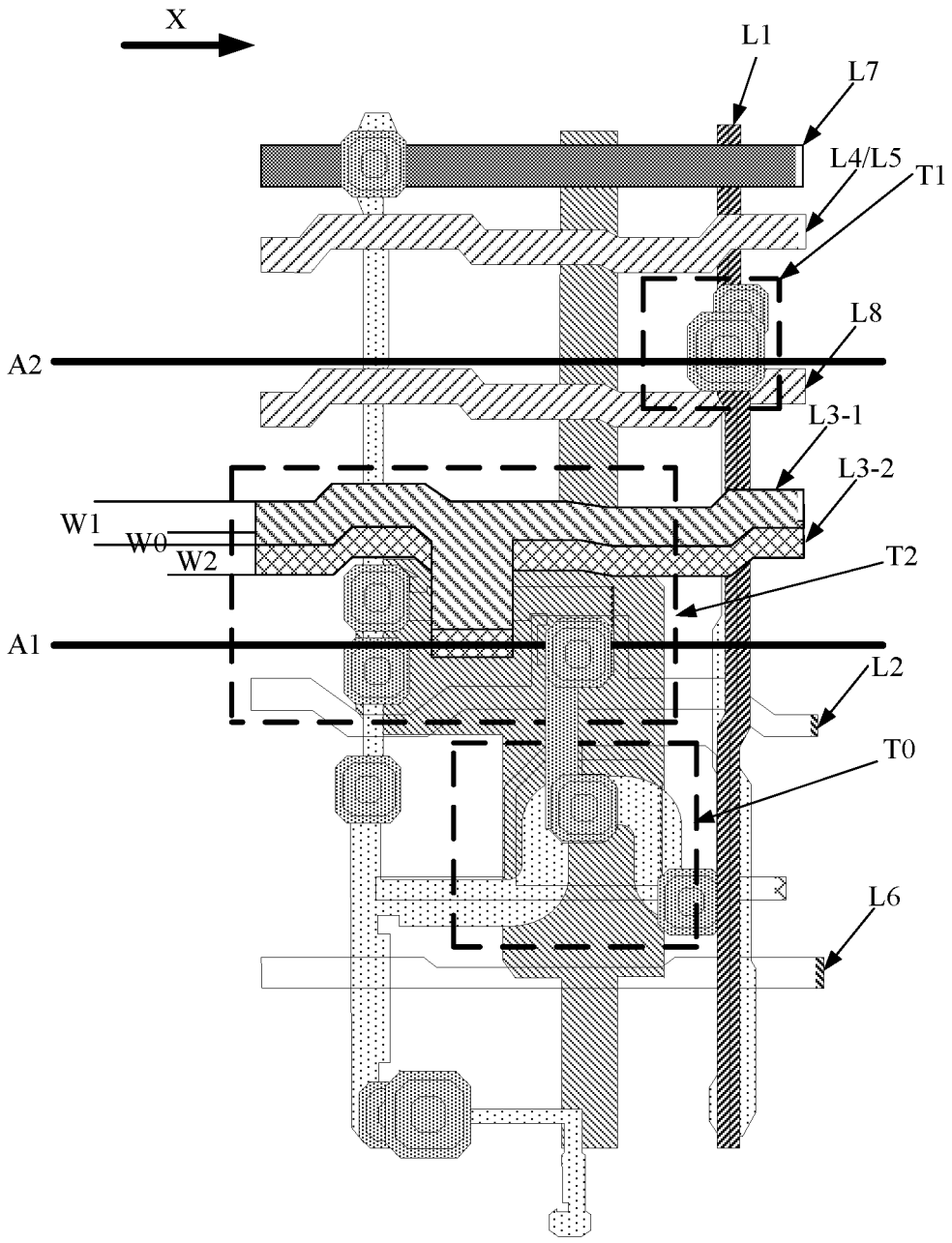
FIG. 7 illustrates another circuit layout of a pixel circuit in an exemplary display panel consistent with various disclosed embodiments in the present disclosure.

FIG. 7 illustrates another circuit layout of a pixel circuit in an display panel provided by another embodiment of the present disclosure.

As shown in FIG. 7, when being orthographically projected onto the plane parallel to the surface of the display panel, a width of the portion of the first signal line L3-1 located between the first edge A1 and the second edge A2 may be W1, and a width of the portion of the second signal line L3-2 located between the first edge A1 and the second edge A2 may be W2. A width of an overlapping portion between the first signal line L3-1 and the second signal line L3-2 may be W0.

$0 \leq W0 < Wx$, where Wx is the smaller value of W1 and W2.

It should be noted that the aforementioned width is the width of the first signal line L3-1 and the second signal line L3-2 in a plane parallel to the surface of the display panel and perpendicular to the extending direction thereof.

Specifically, when $W0=0$, it may mean that the first signal line L3-1 and the second signal line L3-2 do not overlap at all; when $0<W0<Wx$, it may mean that the first signal line L3-1 and the second signal line L3-1 may overlap, but the first signal line L3-1 and the second signal line L3-2 may not completely overlap.

Since the first signal line L3-1 and the second signal line L3-2 are arranged in different layers, when the first signal line L3-1 and the second signal line L3-2 completely overlap, the electric field lines blocked by the first signal line L3-1 and the second signal line L3-1 jointly may be the least. When the overlapping area of the first signal line L3-1 and the second signal line L3-2 decreases, that is, when the non-overlapping area of the first signal line L3-1 and the second signal line L3-2 increases, the electric field lines jointly blocked by the signal line L3-1 and the second signal line L3-2 will also increase accordingly.

Therefore, in the embodiment of the present disclosure, $0 \leq W0 < Wx$ may be configured, such that the electric field lines between the first edge A1 and the second edge A2 may be blocked to the greatest extent, to reduce the electric field between the first edge A1 and the second edge A2 to the greatest extent. The parasitic capacitance may be reduced and the stability of the gate voltage of the driving transistor T0 may be enhanced.

Moreover, since the first signal line L3-1 and the second signal line L3-2 are arranged in different layers, and the first signal line L3-1 and the second signal line L3-2 are arranged in layers different from the first metal layer M1, when the first signal line L3-1 and the second signal line L3-2 have a small overlap area or do not overlap at all, there may not be a large impact on the first edge A1 and the second edge A2.

Optionally, in another embodiment of the present disclosure, the width W1 of the first signal line L3-1 may be larger than the width W2 of the second signal line L3-2.

Specifically, since the top gate G1 and the bottom gate G2 are located between the second metal layer M2 and the film layer where the first metal layer M1 is located, and the top gate G1 is located on the side of the bottom gate G2 facing the first metal layer M1, in a direction perpendicular to the surface of the base substrate, the distance between the first signal line L3-1 and the first metal layer M1 may be smaller than the distance between the second signal line L3-2 and the first metal layer M1, that is, the first signal line L3-1 may be closer to the first metal layer M1 than the second signal line L3-2.

Based on the electric field characteristics, the electric field intensity in the area where the first signal line L3-1 is located may be larger than the electric field intensity in the area where the second signal line L3-2 is located. A density of the electric field lines in the area where the signal line L3-1 is located may be larger, that is, the electric field lines in the area where the signal line L3-1 is located may be denser.

Therefore, in the embodiment of the present disclosure, the width of the first signal line L3-1 may be set to be larger to block more electric field lines to the greatest extent, to sufficiently weaken the electric field between the first edge A1 and the second edge A2. Therefore, the parasitic capacitance may be reduced and the stability of the gate voltage of the driving transistor T0 may be enhanced.

Optionally, in another embodiment, as shown in FIG. 3 to FIG. 7, the signal line group in the display panel may further include a third signal line L8. When being orthographically projected to the plane parallel to the surface of the display panel, the third signal line L8 may be located on one side of the first signal line L3-1 and the second signal line L3-2 away from the first edge A1, and at least part of the area of the third signal line L8 may be also located between the first edge A1 and the second edge A2.

Specifically, in the present embodiment, in conjunction with the circuit diagram shown in FIG. 1, the third signal line L8 may be used to transmit an initialization signal VAR to the anode of the light-emitting element Q to initialize the light-emitting element Q.

Optionally, the third signal line L8 and the first signal line L3-1 may be arranged in the same layer. Since the top gate G1 and the bottom gate G2 may be located between the second metal layer M2 and the film layer where the first metal layer M1 is located, and the top gate G1 may be located on the side of the bottom gate G2 facing the first metal layer M1; it indirectly illustrates the distance between the first signal line L3-1 and the first metal layer M1 and the distance between the third signal line L8 and the first metal layer M1 may be same, and both may be smaller than the distance between the second signal line L3-2 and the first metal layer M1. That is, the first signal line L3-1 and the third signal line L8 may be closer to the first metal layer M1 than the second signal line L3-2.

Based on the electric field characteristics, the first signal line L3-1 and the third signal line L8 may be relatively close to the first metal layer M1, and the electric field intensity in the area where the first signal line L3-1 and the third signal line L8 are located may be larger than the electric field intensity in the area where the second signal line L3-2 is located. The electric field line density in the area where the first signal line L3-1 and the third signal line L8 are located may be larger, that is, the electric field line in the area where the first signal line L3-1 and the third signal line L8 are located may be denser.

Therefore, in the present embodiment, more signal lines may be disposed in the area with higher electric field line density to block more electric field lines to the greatest extent. Three signal lines may be located between the first edge A1 and the second edge A2, to block the electric field lines between the first edge A1 and the second edge A2. Correspondingly, the electric field between the first edge A1 and the second edge A2 may be sufficiently weakened, therefore reducing the parasitic capacitance and enhance the stability of the gate voltage of the driving transistor T0.

Figure 8:
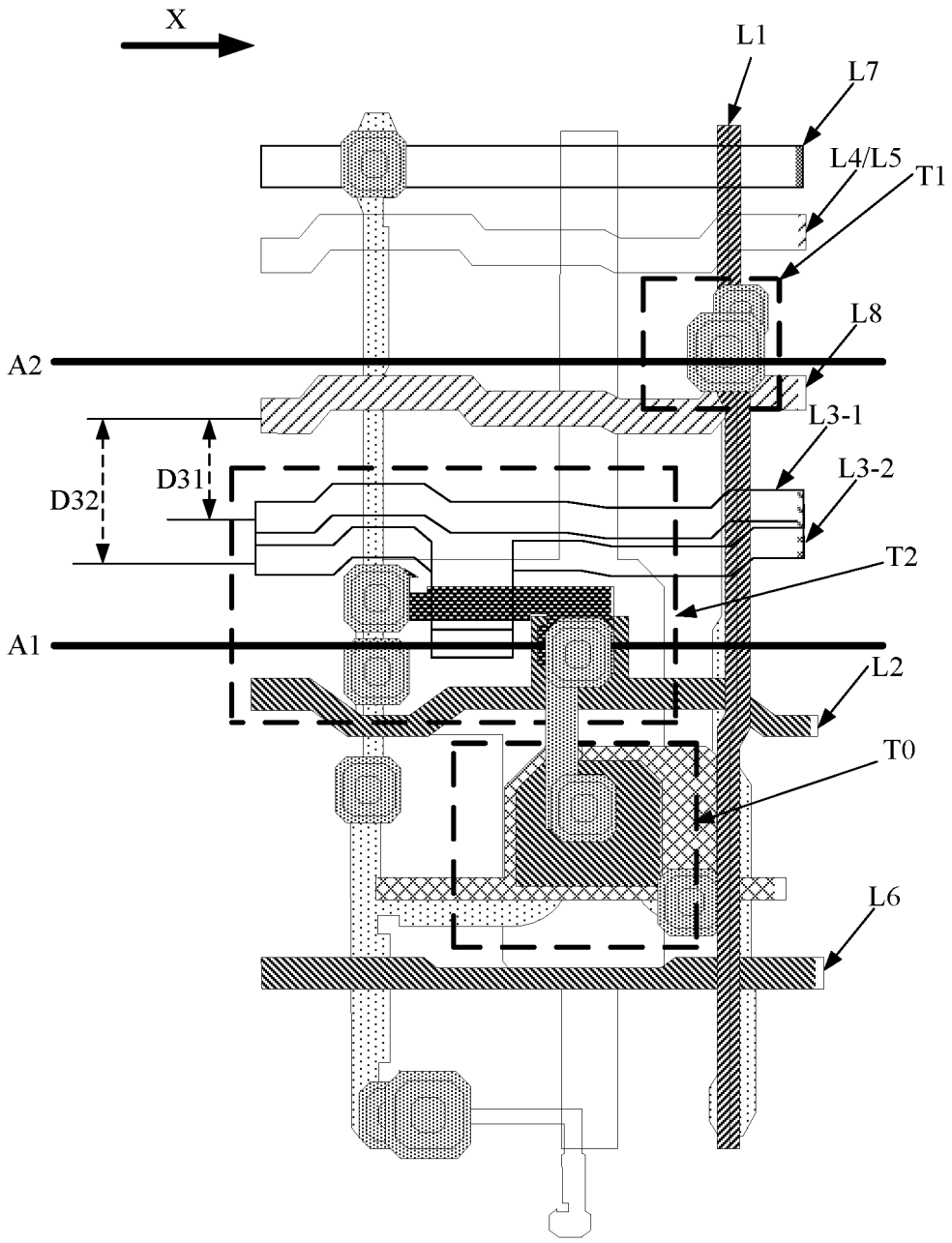
FIG. 8 illustrates another circuit layout of a pixel circuit in an exemplary display panel consistent with various disclosed embodiments in the present disclosure.

FIG. 8 illustrates another circuit layout of a pixel circuit in an display panel provided by another embodiment of the present disclosure.

As shown in FIG. 8, when being orthographically projected onto the plane parallel to the surface of the display panel, a distance D31 between the third signal line L8 and the first signal line L3-1 may be larger than a distance D32 between the second signal line L3-2 and the third signal line L8.

Specifically, since the third signal line L8 and the first signal line L3-1 may be located on the same layer, and the third signal line L8 may also extend along the first direction X, to avoid the interference occurred between the first signal line L3-1 and the third signal line L8, the distance between the first signal line L3-1 and the third signal line L8 may need to be increased.

Moreover, when increasing the distance between the first signal line L3-1 and the third signal line L8, more electric field lines can be additionally blocked. Correspondingly, the electric field between the first edge A1 and the second edge A2 may be sufficiently weakened, therefore reducing the parasitic capacitance and enhance the stability of the gate voltage of the driving transistor T0.

It should be noted that the lengths of the bidirectional arrows of the distance between the first signal line L3-1, the second signal line L3-2, and the third signal line L8 in FIG. 8 do not indicate the value of the distance. The relationship between the size of each distance is subject to the text described in the specification.

Figure 9:
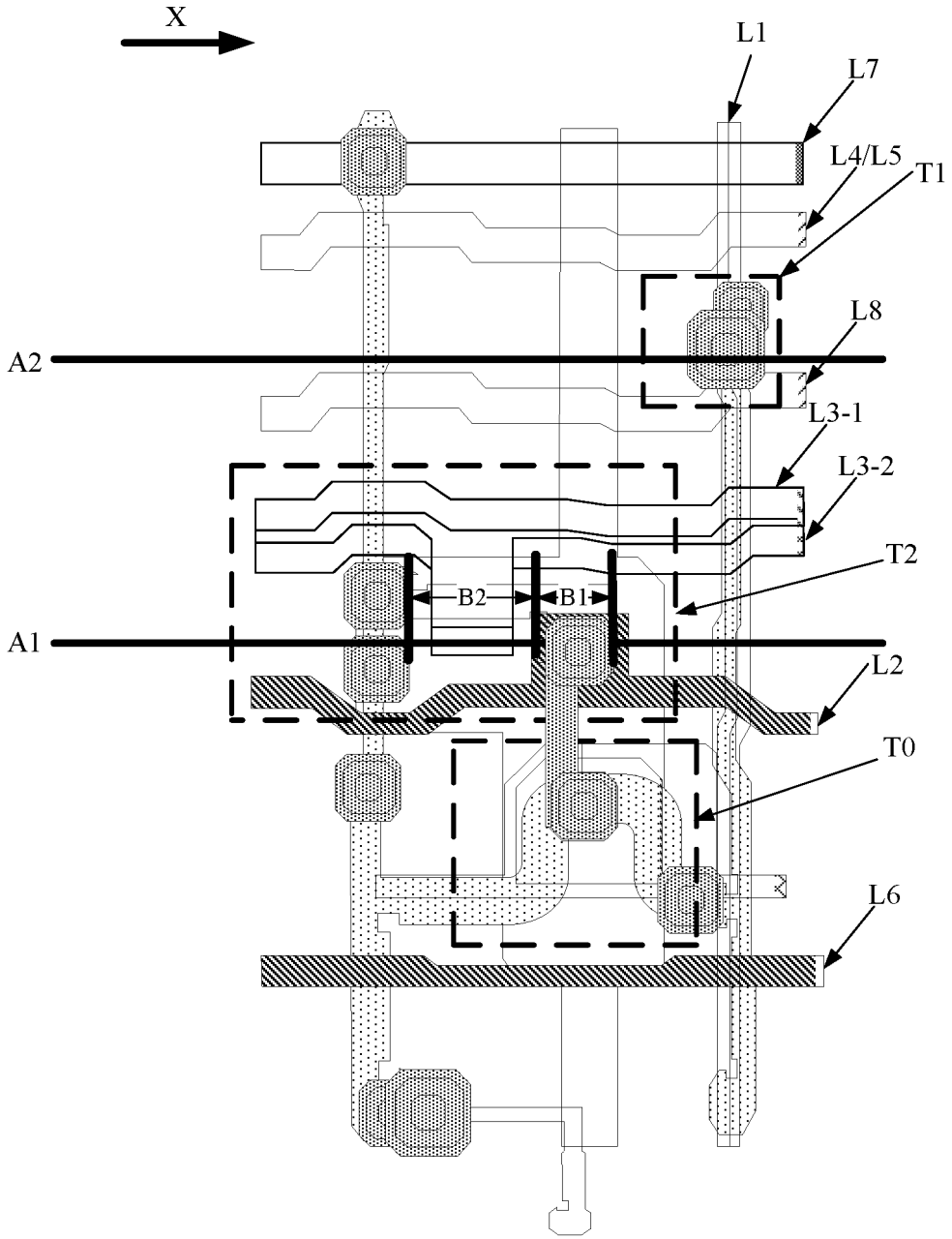
FIG. 9 illustrates another circuit layout of a pixel circuit in an exemplary display panel consistent with various disclosed embodiments in the present disclosure.

FIG. 9 illustrates another circuit layout of a pixel circuit in an display panel provided by another embodiment of the present disclosure.

As shown in FIG. 9, the signal line group in the display panel may further include a sixth signal line L2. The sixth signal line L2 may be connected to the gate of the data writing transistor T1 for providing the control signal to the data writing transistor T1. The sixth signal line L2 may be located between the first signal line L3-1 and/or the second signal line L3-2 and the gate of the driving transistor T0.

The active layer of the first transistor T2 may include a first region B1 and a second region B2.

As shown in FIG. 2, the first area B1 and the sixth signal line L2 may overlap each other to form a first capacitor C1.

The second region B2 may overlap with the first signal line L3-1 and the second signal line L3-2 to form a channel region of the first transistor T2.

Figure 10:
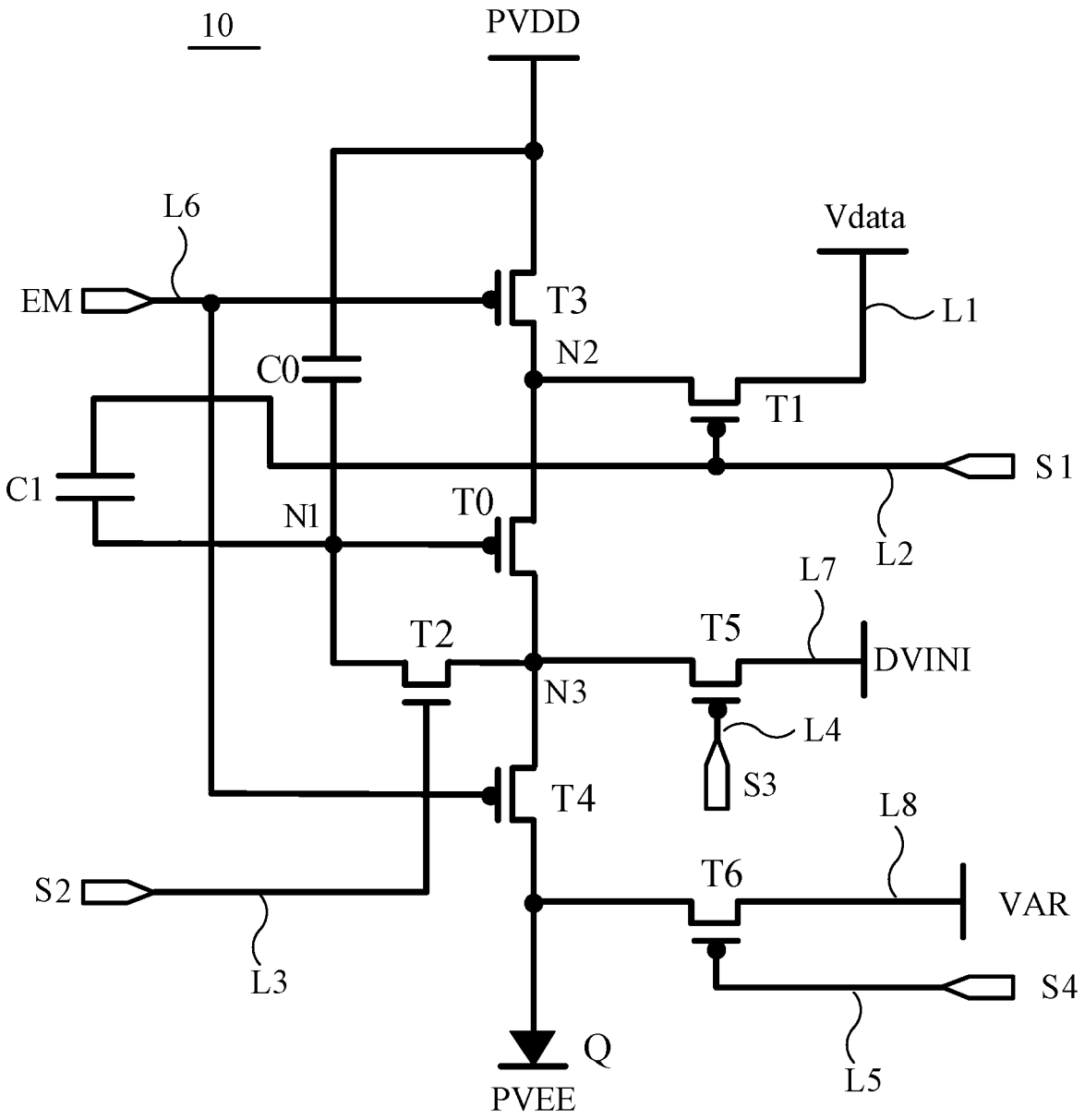
FIG. 10 illustrates another circuit layout of a pixel circuit in an exemplary display panel consistent with various disclosed embodiments in the present disclosure.

In the present embodiment, as shown in FIG. 10 illustrating another circuit structure of the pixel circuit in the display panel, the first capacitor C1 may form between the gate of the driving transistor T0 and the line of the gate of the data writing transistor T1, that is, the sixth signal line L2.

Since the first signal line L3-1 and the second signal line L3-2 need to be arranged between the first edge A1 and the second edge A2 to block the electric field lines between the first edge A1 and the second edge A2, to ensure the normal operation of the pixel circuit 10, make the space of the circuit layout as compact as possible, and increase the resolution of the display panel (Pixels Per Inch, PPI), in the present embodiment of the present disclosure, the first transistor T2 may be multiplexed. First, the active layer IGZO of the first transistor T2 may be used as a capacitor plate, such that the first area B1 and the sixth signal line L2 overlap with each other to form the first capacitor C1. Secondly, the second area B2 of the first transistor T2 may overlap with the first signal line L3-1 and the second signal line L3-2, to form the channel region of the first transistor T2. Correspondingly, the limited space of the circuit layout may be utilized effectively, to accommodate more structures when the pixel circuit 10 can operate normally and make the space of the circuit layout as compact as possible.

Figure 11:
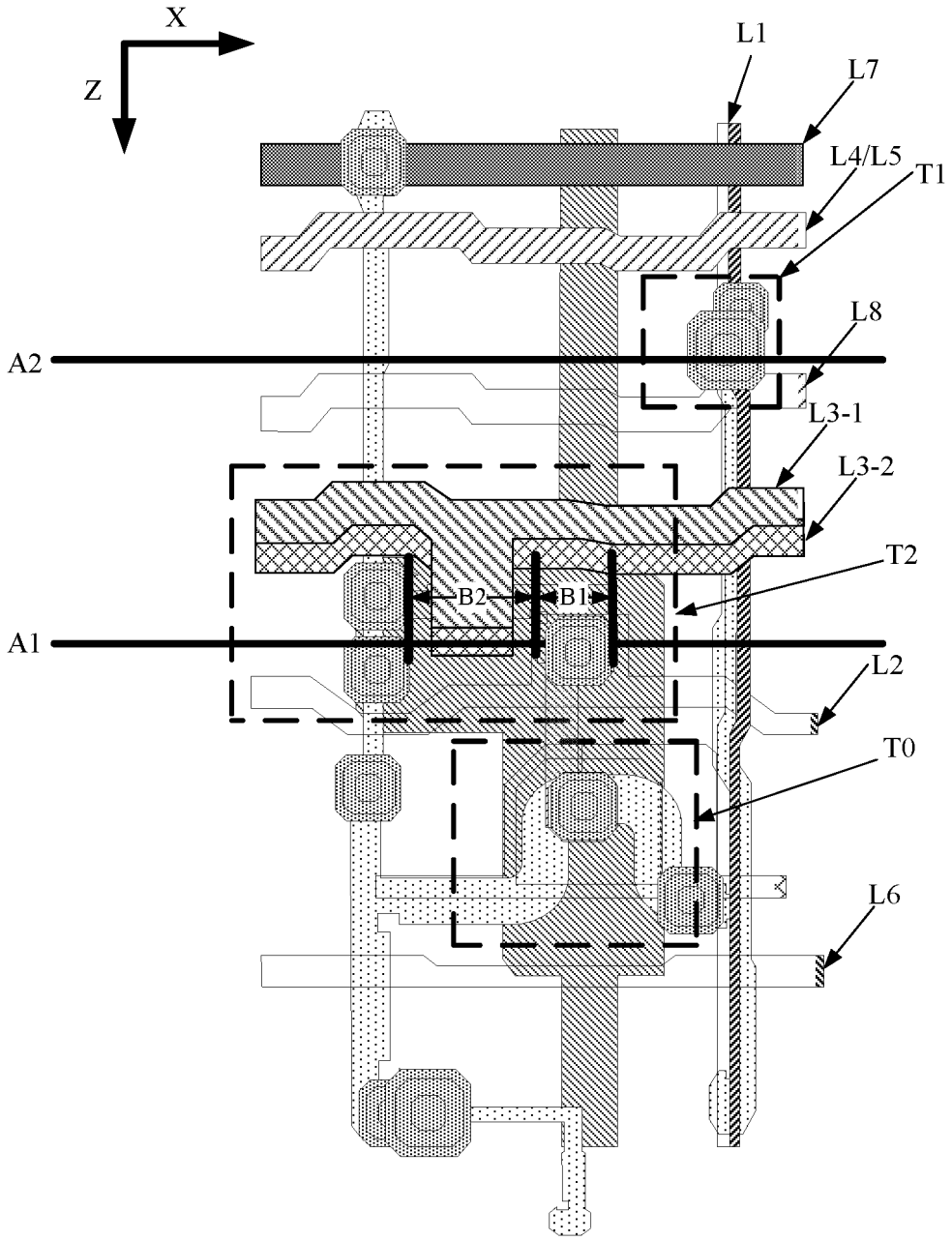
FIG. 11 illustrates another circuit layout of a pixel circuit in an exemplary display panel consistent with various disclosed embodiments in the present disclosure.

FIG. 11 illustrates another circuit layout of a pixel circuit in an display panel provided by another embodiment of the present disclosure.

As shown in FIG. 11, the first area B1 of the active area of the first transistor T2 may extend along a third direction Z, and the second area B2 of the active area of the first transistor T2 may extend along the first direction X. The first direction X and the third direction Z may be perpendicular to each other.

There may be no overlap between the first capacitor C1 and the channel region of the first transistor T2.

Specifically, a long distance between the second edge A2 and the gate of the driving transistor T0 may induce a larger space occupied by the pixel circuit and affect the resolution of the display panel. To avoid this problem, the first area B1 of the active area of the first transistor T2 may extend along a third direction Z, and the second area B2 of the active area of the first transistor T2 may extend along the first direction X, to avoid too many structures disposed in the third direction Z. When several signal lines are disposed between the first edge A1 and the second edge A2, it can be avoided that the distance between the second edge A2 and the gate of the driving transistor T0 is too far and the overall area of the pixel circuit is too larger.

Figure 12:
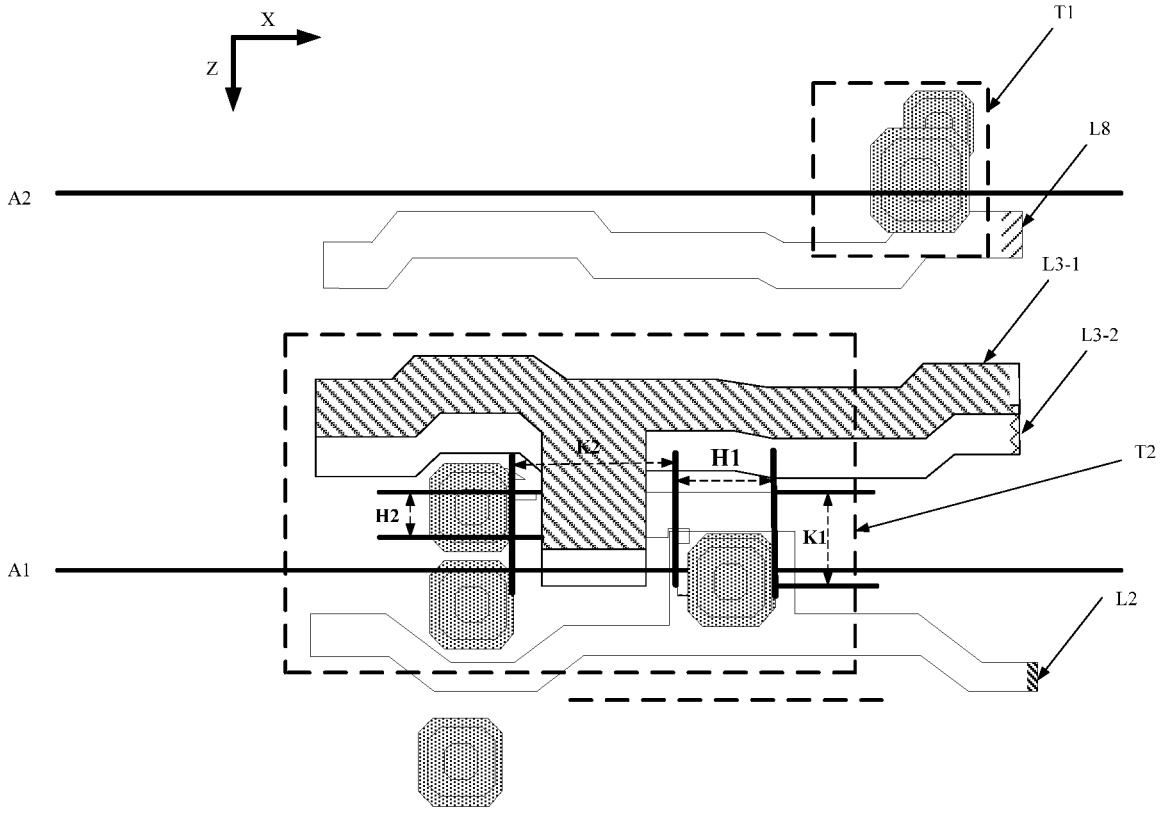
FIG. 12 illustrates another circuit layout of a pixel circuit in an exemplary display panel consistent with various disclosed embodiments in the present disclosure.

FIG. 12 illustrates another circuit layout of a pixel circuit in an display panel provided by another embodiment of the present disclosure.

As shown in FIG. 12, the width of the first region B1 of the active region of the first transistor T2 along the first direction X may be H1, and the length of the first region B1 of the active region of the first transistor T2 along the third direction Z may be K1. H1>K1.

The length of the second region B2 of the active region of the first transistor T2 along the first direction X is K2, and the width of the second region B2 of the active region of the first transistor T2 along the third direction Z may be H2. K2>H2.

Specifically, since the active layer of the first transistor T2 may be used as the capacitor plate on the one hand, the first area B1 and the sixth signal line L2 may overlap with each other to form the first capacitor C1. Under the condition that it is ensured that the first capacitor C1 has a certain value, the width of the first region B1 of the active layer of the first transistor T2 in the first direction X may be as large as possible, and the length in the third direction Z may be as small as possible, to ensure the first capacitor C1 has a larger plate area and prevent the first edge A1 and the second edge A2 from being too far apart in the third direction Z at the same time.

Further, since the second region B2 of the active layer of the first transistor T2 may overlap with the first signal line L3-1 and the second signal line L3-2 to form the channel region of the first transistor T2, the length of the channel region can be appropriately extended in the first direction X, to make the length of the channel region larger than the width in the third direction Z.

Optionally, in another embodiment, the signal line group in the display panel may include at least one signal line that provides control signals or input signals for the transistors of the pixel circuit. For example, the signal line group may include the signal line L1 that provides the data signal Vdata, the signal line L2 that provides the control signal S1, the signal line L3 that provides the control signal S2, the signal line L4 that provides the control signal S3, the signal line L5 that provides the control signal S4, the signal line L6 that provides the control signal EM, the signal line L7 that provides the reset signal DVINI, the signal line L8 that provides the initialization signal VAR, and so on.

That is, the signal lines located between the first edge A1 and the second edge A2 may be not limited to the first signal line L3-1, the second signal line L3-1, and the third signal line L8, but can also be other signal lines.

That is, when being orthographically projected to the plane parallel to the surface of the display panel, the signal line group may include the fourth signal line, and at least a part of the fourth signal line may be located between the first edge A1 and the second edge A2.

The fourth signal line may be located in the fourth metal layer, and the fourth metal layer and the first metal layer M1 may be arranged in different layers.

Specifically, any signal line located between the first edge A1 and the second edge A2 can be used as the fourth signal line to block the electric field lines between the first edge A1 and the second edge A2 and weaken the electric field between the first edge A1 and the second edge A2. The parasitic capacitance may be reduced and the stability of the gate voltage of the driving transistor T0 may be enhanced.

It should be noted that, in the present disclosure, the specific function of the fourth signal line is not limited in the embodiment of the present application.

It should be noted that in the present disclosure, the fourth signal line is not shown in the drawings of the specification.

Optionally, in another embodiment, the fourth metal layer may be located between the second metal layer M2 and the first metal layer M1.

In the direction perpendicular to the surface of the display panel, the distance between the first metal layer M1 and the fourth metal layer may be smaller than the distance between the second metal layer M2 and the fourth metal layer.

Specifically, when it is closer to the area where the first metal layer M1 is located, the electric field line density between the first edge A1 and the second edge A2 may be larger, and the electric field intensity may be larger.

Correspondingly, in the direction perpendicular to the surface of the display panel, the distance between the first metal layer M1 and the fourth metal layer may be configured to be smaller than the distance between the second metal layer M2 and the fourth metal layer. Since the fourth signal line may be located in the fourth metal layer, the distance between the fourth signal line and the first metal layer M1 may be also smaller than the distance between the fourth signal line and the second metal layer M2. That is, the fourth signal line may be closer to the first metal layer M1 and may block more electric field lines to the greatest extent. Correspondingly, the electric field between the first edge A1 and the second edge A2 may be sufficiently weakened, therefore reducing the parasitic capacitance and enhance the stability of the gate voltage of the driving transistor T0.

Optionally, in another embodiment, when being orthographically projected to the plane parallel to the surface of the display panel, the distance between the fourth signal line and the first edge A1 may be larger than that the distance between the fourth signal line and the second edge A2.

Specifically, on the premise that the fourth signal line can block the electric field lines between the first edge A1 and the second edge A2, the blocking effect of the fourth signal line on the electric field lines may be further optimized.

Since the first edge A1 may be the side of the first electrode of the first transistor T2 facing the first electrode of the data writing transistor T1, and the first electrode of the first transistor T2 may be connected to the gate of the driving transistor T0, it can be understood that the first edge A1 may be connected to the gate of the driving transistor T0.

When the fourth signal line is relatively close to the first edge A1, the fourth signal line may also cause interference on the first edge A1, thereby affecting the stability of the gate voltage of the driving transistor T0.

Correspondingly, to reduce the interference phenomenon on the first edge A1 and fully ensure the stability of the gate voltage of the driving transistor T0, the distance between the fourth signal line and the first edge A1 can be sufficiently large, that is, it may be configured that the distance between the fourth signal line and the first edge A1 is larger than the distance between the fourth signal line and the second edge A2.

Optionally, in another embodiment, the signal line group in the display panel may include at least one signal line that provides control signals or input signals for the transistors of the pixel circuit. For example, the signal line group may include the signal line L1 that provides the data signal Vdata, the signal line L2 that provides the control signal S1, the signal line L3 that provides the control signal S2, the signal line L4 that provides the control signal S3, the signal line L5 that provides the control signal S4, the signal line L6 that provides the control signal EM, the signal line L7 that provides the reset signal DVINI, the signal line L8 that provides the initialization signal VAR, and so on.

That is, the signal lines located between the first edge A1 and the second edge A2 may be not limited to the first signal line L3-1, the second signal line L3-1, and the third signal line L8, but can also be other signal lines.

That is, when being orthographically projected to the plane parallel to the surface of the display panel, the signal line group may include the fifth signal line, and at least a part of the fifth signal line may be located between the first edge A1 and the second edge A2.

The fifth signal line may be located in the fifth metal layer, and the fifth metal layer and the first metal layer M1 may be arranged in different layers.

Specifically, any signal line located between the first edge A1 and the second edge A2 can be used as the fifth signal line to block the electric field lines between the first edge A1 and the second edge A2 and weaken the electric field between the first edge A1 and the second edge A2. The parasitic capacitance may be reduced and the stability of the gate voltage of the driving transistor T0 may be enhanced.

It should be noted that, in the present disclosure, the specific function of the fifth signal line is not limited in the embodiment of the present application.

Further, the fourth signal line and the fifth signal line may be located between the first edge A1 and the second edge A2. Two signal lines between the first edge A1 and the second edge A2 may be more beneficial for blocking more electric field lines between the first edge A1 and the second edge A2. Correspondingly, the electric field between the first edge A1 and the second edge A2 may be sufficiently weakened, therefore reducing the parasitic capacitance and enhance the stability of the gate voltage of the driving transistor T0.

It should be noted that in the present disclosure, the fourth signal line is not shown in the drawings of the specification.

Optionally, in another embodiment, the fourth metal layer may be located on a side of the fifth metal layer facing the first metal layer M1.

When being orthographically projected to the plane parallel to the surface of the display panel, the fourth signal line may be located on a side of the fifth signal line facing the second edge A2.

Specifically, since the first edge A1 is the side of the first electrode of the first transistor T2 facing the first electrode of the data writing transistor T1 and the first electrode of the first transistor T2 is connected to the gate of the driving transistor T0, it can be understood that the first edge A1 may be connected to the gate of the driving transistor T0.

The fourth metal layer may be located on the side of the fifth metal layer facing the first metal layer M1. That may mean that the fourth metal layer is closer to the first metal layer M1 than the fifth metal layer. When the fourth signal line is close to the first edge A1, the fourth signal line may also cause interference to the first edge A1, which in turn affects the stability of the gate voltage of the driving transistor T0.

Therefore, the fourth signal line may be disposed on the side close to the second edge A2. The influence of the fourth signal line on the first edge A1 may be reduced, to fully ensure the stability of the gate voltage of the driving transistor T0.

Figure 13:
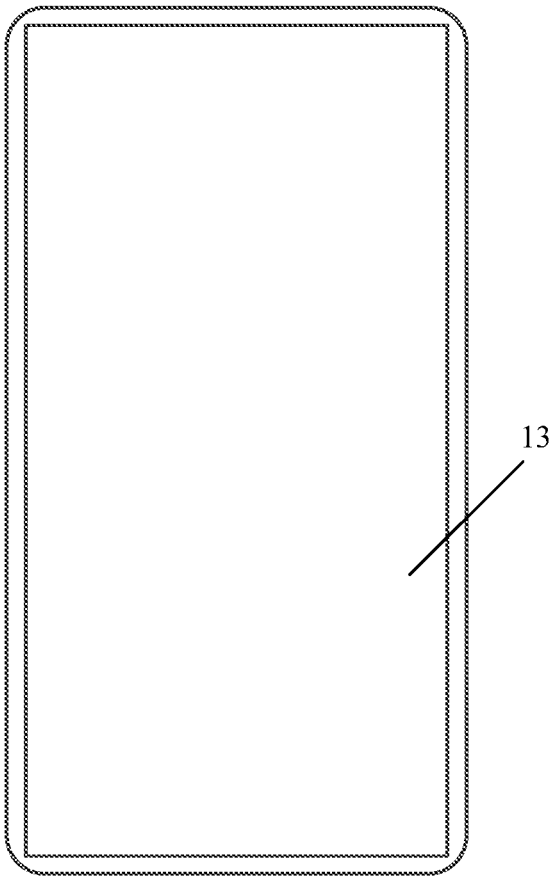
FIG. 13 illustrates an exemplary display device consistent with various disclosed embodiments in the present disclosure.

The present disclosure also provides a display device. As shown in FIG. 13, the display device 13 may include a display panel provided by various embodiments of the present disclosure.

In various embodiments, the display device 13 may be a cell phone, a computer, or any other electronic device.

In the present disclosure, at least one signal line may be located between the first edge and the second edge of the display panel. That is, when being orthographically projected to the plane parallel to the surface of the display panel, at least a part of the area of at least one signal line in the signal line group may be located between the first edge and the second edge. When the lateral electric field is generated between the first electrode of the first transistor and the first electrode of the data writing transistor, the signal line located between the first edge and the second edge may block the electric field line, to weaken the electric field in the local area. Therefore, the parasitic capacitance may be reduced and the voltage stability of the first electrode of the first transistor may be improved, enhancing the stability of the gate voltage of the driving transistor.

Further, to avoid the situation that a lateral electric field is formed between the signal line between the first edge and the second edge and the first electrode of the first transistor and/or the first electrode of the data writing transistor when the signal line between the first edge and the second edge and the first electrode of the first transistor and/or the first electrode of the data writing transistor are in the same layer, the signal line between the first edge and the second edge and the first metal layer are arranged in different layers, to avoid that the first electrode of the first transistor and/or the first electrode of the data writing transistor are located in the same layer. Unnecessary interference may be reduced, to further improve the stability of the gate voltage of the drive transistor.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments, but may be embodied in other equivalent forms without departing from the scope of the present disclosure, which is determined by the appended claims.

What is claimed is:

1. A display panel, comprising:

a pixel circuit and a light-emitting element, wherein:

the pixel circuit includes transistors, the transistors including a driving transistor for providing a driving current to the light-emitting element, a data writing transistor for providing a data signal to the driving transistor, and a first transistor; and a signal line group including at least one signal line for providing control signals or input signals for the transistors in the pixel circuit, wherein:

the data writing transistor is connected between a first electrode of the driving transistor and a data signal line;

a first electrode of the first transistor is connected to a gate of the driving transistor;

the first electrode of the first transistor and a first electrode of the data writing transistor are located in a first metal layer;

a side of the first electrode of the first transistor facing the first electrode of the data writing transistor is a first edge;

a side of the first electrode of the data writing transistor facing the first electrode of the first transistor is a second edge; and when being orthographically projected on a plane parallel to a surface of the display panel, at least a partial region of at least one signal line in the signal line group is located between the first edge and the second edge, and the at least a partial region of the at least one signal line and the first metal layer are arranged in different layers.

2. The display panel according to claim 1, wherein:

a gate of the driving transistor is located in a second metal layer, and is connected to the first electrode of the first transistor through a via hole; and the data signal line is located in a third metal layer, and is connected to the first electrode of the data writing transistor through a via hole, or the first electrode of the data writing transistor is connected to the first electrode of the driving transistor.

3. The display panel according to claim 1, wherein:

the pixel circuit includes silicon transistors and oxide semiconductor transistors;

an active layer of a silicon transistor of the silicon transistors is made of a material including silicon;

an active layer of an oxide semiconductor transistor of the oxide semiconductor transistors is made of a material including an oxide semiconductor;

in a direction perpendicular to the surface of the display panel, the oxide semiconductor transistor includes a top gate and a bottom gate located on two sides of the active layer respectively, and the top gate is located at a side of the bottom gate facing the first metal layer; and the first transistor is one of the oxide semiconductor transistors.

4. The display panel according to claim 3, wherein:

when being orthographically projected to the plane parallel to the surface of the display panel, at least a partial region of the first signal line in the signal line group is located between the first edge and the second edge, and at least a partial region of a second signal line in the signal line group is also located between the first edge and the second edge;

the first signal line is connected to the top gate of the first transistor to provide a control signal for the top gate of the first transistor;

the second signal line is connected to the bottom gate of the first transistor to provide a control signal for the bottom gate of the first transistor; and the first signal line and the second signal line extend along a first direction.

5. The display panel according to claim 4, wherein:

when being orthographically projected to the plane parallel to the surface of the display panel, the first edge and the second edge are located at two sides of the first signal line after extending along the first direction, and the first edge and the second edge are located at two sides of the second signal line after extending along the first direction.

6. The display panel according to claim 4, wherein:

the first signal line includes a first protrusion extending in a second direction;

the second signal line includes a second protrusion extending in the second direction;

the first direction and the second direction intersect each other; and the first edge and the second edge are located at two sides of the first protrusion after extending in the second direction, and the first edge and the second edge are located at two sides of the second protrusion after extending along the second direction.

7. The display panel according to claim 4, wherein:

when being orthographically projected to the plane parallel to the surface of the display panel, a distance from the part of the first signal line located between the first edge and the second edge to the first edge is D11;

a distance from the part of the second signal line located between the first edge and the second edge to the first edge is D12;

a distance from the part of the first signal line located between the first edge and the second edge to the second edge is D21;

a distance from the part of the second signal line located between the first edge and the second edge to the second edge is D22; and D11>D21, and/or D12>D22.

8. The display panel according to claim 4, wherein:

when being orthographically projected to the plane parallel to the surface of the display panel, a width of the part of the first signal line located between the first edge and the second edge is W1, a width of the part of the second signal line located between the first edge and the second edge is W2;

a width of an overlapping part of the first signal line and the second signal line is W0; and $0 \leq W0 < Wx$, wherein Wx is a smaller value of W1 and W2.

9. The display panel according to claim 4, wherein:

a width of the first signal line is larger than a width of the second signal line.

10. The display panel according to claim 4, wherein:

the signal line group further includes a third signal line; and when being orthographically projected to the plane parallel to the surface of the display panel, the third signal line is located at a side of the first signal line and the second signal line away from the first signal line, and at least a partial region of the third signal line is also located between the first edge and the second edge.

11. The display panel according to claim 10, wherein:

the third signal line and the first signal line are located in a same layer;

the third signal line also extends along the first direction; and when being orthographically projected to the plane parallel to the surface of the display panel, a distance between the third signal line and the first signal line is larger than a distance between the second signal line and the third signal line.

12. The display panel according to claim 4, wherein:

the signal line group further includes a sixth signal line;

the sixth signal line is connected to the gate of the data writing transistor for providing control signals for the data writing transistor;

the sixth signal line is located between the first signal line and/or the first signal line and the gate of the driving transistor;

an active layer of the first transistor includes a first area and a second area;

the first area and the sixth signal line overlap with each other to form a first capacitor; and the second area overlaps the first signal line and the second signal line to form a channel region of the first transistor.

13. The display panel according to claim 12, wherein:

the first area extends in a third direction;

the second area extends in the first direction;

the first direction and the third direction are perpendicular to each other; and the first capacitor does not overlap with the channel region of the first transistor.

14. The display panel according to claim 13, wherein:

a width of the first area along the first direction is H1, and a length of the first area along the third direction is K1, wherein H1>K1; and a length of the second area along the first direction is K2, and a width of the second area along the third direction is K2, wherein K2>H2.

15. A display device, comprising a display panel, wherein:

the display panel includes:

a pixel circuit and a light-emitting element, wherein:

the pixel circuit includes transistors, wherein the transistors include a driving transistor for providing a driving current to the light-emitting element, a data writing transistor for providing a data signal to the driving transistor, and a first transistor; and a signal line group including at least one signal line for providing control signals or input signals for the transistors in the pixel circuit, wherein:

the data writing transistor is connected between a first electrode of the driving transistor and a data signal line;

a first electrode of the first transistor is connected to a gate of the driving transistor;

the first electrode of the first transistor and a first electrode of the data writing transistor are located in a first metal layer;

a side of the first electrode of the first transistor facing the first electrode of the data writing transistor is a first edge;

a side of the first electrode of the data writing transistor facing the first electrode of the first transistor is a second edge; and when being orthographically projected on a plane parallel to a surface of the display panel, at least a partial region of at least one signal line in the signal line group is located between the first edge and the second edge, and the at least a partial region of the at least one signal line and the first metal layer are arranged in different layers.

16. The display device according to claim 15, wherein:

a gate of the driving transistor is located in a second metal layer, and is connected to the first electrode of the first transistor through a via hole; and the data signal line is located in a third metal layer, and is connected to the first electrode of the data writing transistor through a via hole, or the first electrode of the data writing transistor is connected to the first electrode of the driving transistor.

17. The display device according to claim 15, wherein:

the pixel circuit includes silicon transistors and oxide semiconductor transistors;

an active layer of a silicon transistor of the silicon transistors is made of a material including silicon;

an active layer of an oxide semiconductor transistor of the oxide semiconductor transistors is made of a material including an oxide semiconductor;

in a direction perpendicular to the surface of the display panel, the oxide semiconductor transistor includes a top gate and a bottom gate located on two sides of the active layer respectively, and the top gate is located at a side of the bottom gate facing the first metal layer; and the first transistor is one of the oxide semiconductor transistors.

18. The display device according to claim 17, wherein:

when being orthographically projected to the plane parallel to the surface of the display panel, at least a partial region of the first signal line in the signal line group is located between the first edge and the second edge, and at least a partial region of a second signal line in the signal line group is also located between the first edge and the second edge;

the first signal line is connected to the top gate of the first transistor to provide a control signal for the top gate of the first transistor;

the second signal line is connected to the bottom gate of the first transistor to provide a control signal for the bottom gate of the first transistor; and the first signal line and the second signal line extend along a first direction.

19. The display device according to claim 18, wherein:

when being orthographically projected to the plane parallel to the surface of the display panel, the first edge and the second edge are located at two sides of the first signal line after extending along the first direction, and the first edge and the second edge are located at two sides of the second signal line after extending along the first direction.

20. The display device according to claim 18, wherein:

the first signal line includes a first protrusion extending in a second direction;

the second signal line includes a second protrusion extending in the second direction;

the first direction and the second direction intersect each other; and the first edge and the second edge are located at two sides of the first protrusion after extending in the second direction, and the first edge and the second edge are located at two sides of the second protrusion after extending along the second direction.

* * * * *